US010646834B2

(12) United States Patent
Benati

(10) Patent No.: US 10,646,834 B2
(45) Date of Patent: May 12, 2020

(54) WINE AERATION DEVICE

(71) Applicant: Carlo Benati, Nogarole Rocca (IT)

(72) Inventor: Carlo Benati, Nogarole Rocca (IT)

( * ) Notice: Subject to any disclaimer, the term of this patent is extended or adjusted under 35 U.S.C. 154(b) by 150 days.

(21) Appl. No.: 15/972,843

(22) Filed: May 7, 2018

(65) Prior Publication Data

US 2018/0250643 A1 Sep. 6, 2018

Related U.S. Application Data

(63) Continuation-in-part of application No. 14/237,148, filed as application No. PCT/EP2012/064978 on Jul. 31, 2012, now Pat. No. 9,980,588.

(30) Foreign Application Priority Data

Aug. 4, 2011 (IT) ..... PI20110016 U

(51) Int. Cl.
*B01F 5/06* (2006.01)
*B01F 3/04* (2006.01)

(52) U.S. Cl.
CPC ..... *B01F 5/0682* (2013.01); *B01F 3/04744* (2013.01); *B01F 3/04787* (2013.01); *B01F 5/0696* (2013.01); *B01F 2003/04879* (2013.01); *B01F 2215/0072* (2013.01)

(58) Field of Classification Search
CPC .... B01F 2003/04879; B01F 2215/0072; B01F 3/04744; B01F 3/04787; B01F 5/0682; B01F 3/0446; B01F 5/0696; A47G 23/00; A47G 23/0241
USPC ..... 99/323.1, 277.1
See application file for complete search history.

(56) References Cited

U.S. PATENT DOCUMENTS

2003/0168754 A1* 9/2003 Spiegel ..... A23L 2/54 261/94
2005/0205609 A1* 9/2005 Moore ..... B01F 3/04475 222/185.1

* cited by examiner

*Primary Examiner* — Dana Ross
*Assistant Examiner* — Joe E Mills, Jr.
(74) *Attorney, Agent, or Firm* — Ference & Associates LLC

(57) ABSTRACT

One embodiment provides a wine aerating device, including: a funnel-shaped container comprising a bottom that is provided with an outlet aperture having a predetermined size, wherein said funnel-shaped container is at least partially filled with a multitude of substantially spherical elements for breaking up and diverting a flow of wine streaming from the top to the bottom of said funnel-shaped container, each of said substantially spherical elements having a size significantly smaller than the size of said outlet aperture, and wherein a non-spherical element having a size greater than the size of said outlet aperture is placed upon said outlet aperture to partially block it, thereby preventing said spherical or nearly-spherical elements to pass through said outlet aperture while allowing the passage of wine through said outlet aperture and increasing the wine's turbulent motion and oxigenation while coming out of said funnel-shaped container. Other aspects are described and claimed.

19 Claims, 4 Drawing Sheets

WINE AERATION DEVICE

CROSS-REFERENCE TO RELATED APPLICATION

This application is a continuation-in-part of co-pending U.S. patent application Ser. No. 14/237,148, filed Feb. 4, 2014, which is a National Phase Entry of PCT International Application No. PCT/EP2012/064978, which was filed on Jul. 31, 2012, and which claims priority to Italian Application No. PI2011U000016, which was filed on Aug. 4, 2011, the contents of which are hereby incorporated by reference as if set forth in their entirety.

TECHNICAL FIELD

The present application relates to a device for aerating or oxygenating wine.

BACKGROUND

Decanting wine is an operation that is carried out for leaving sediments inside of a just opened wine bottle, as well as for oxygenating or aerating the wine before drinking. It is known that wine to be oxygenated is poured into a suitably devised instrument, known as a "decanter", consisting of a receptacle with very large base and rather reduced height, and having a pouring neck. In this way the exchange surface between the air and the wine layer inside the decanter is larger than the corresponding exchange surface inside a wine bottle.

However, it must be noted that the use of decanters is not completely free from drawbacks. The most critical aspect of this technology is related with the rather long time that is necessary to obtain effective aeration or oxygenation of the wine poured inside a decanter. Wine actually needs to "rest" for several minutes, sometimes hours, inside the decanter before being properly aerated or oxygenated.

BRIEF SUMMARY

In summary, one aspect provides a wine aerating device, comprising: a funnel-shaped container comprising a bottom that is provided with an outlet aperture having a predetermined size, wherein said funnel-shaped container is at least partially filled with a multitude of substantially spherical elements for breaking up and diverting a flow of wine streaming from the top to the bottom of said funnel-shaped container, each of said substantially spherical elements having a size significantly smaller than the size of said outlet aperture, and wherein a non-spherical element having a size greater than the size of said outlet aperture is placed upon said outlet aperture in order to partially block it, thereby preventing said spherical or nearly-spherical elements to pass through said outlet aperture while allowing allowing the passage of wine through said outlet aperture and increasing the wine's turbulent motion and oxigenation while coming out of said funnel-shaped container.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
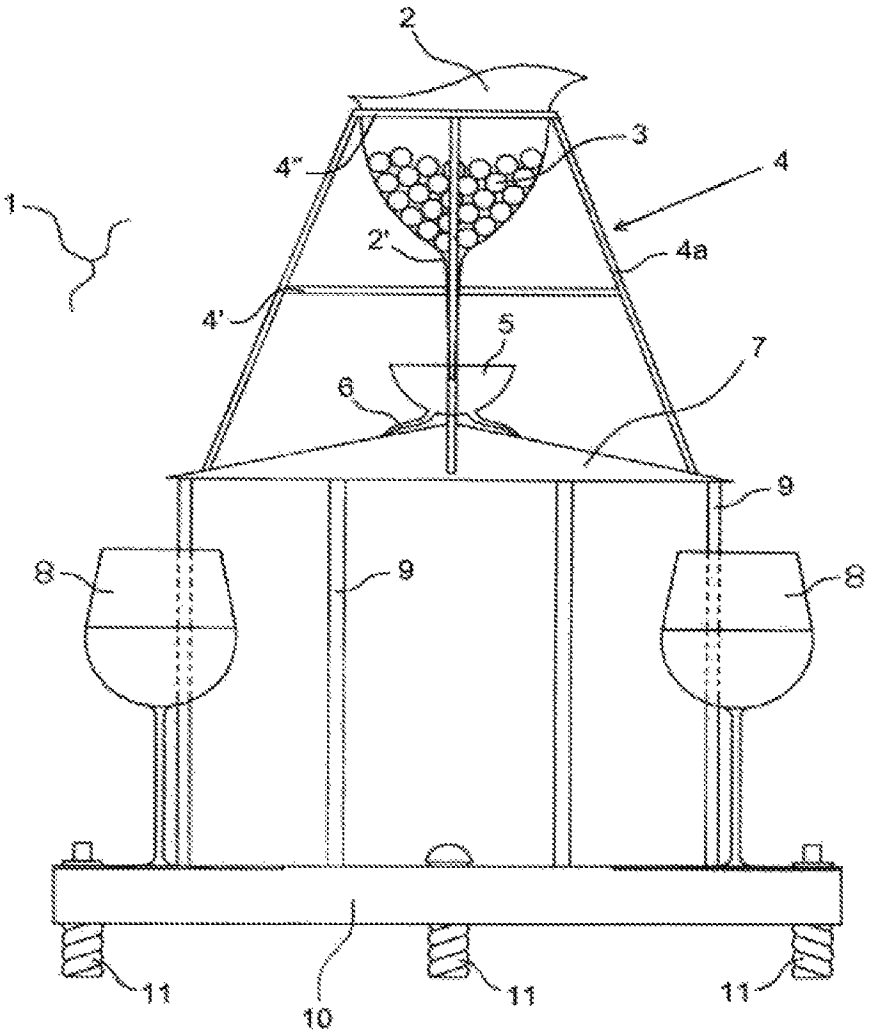
FIG. 1 is a side view of a device according to the present invention.
Figure 4:
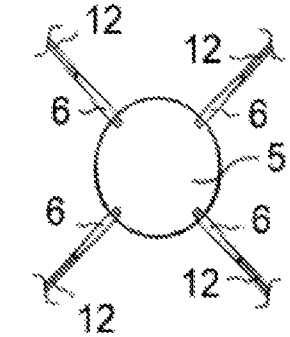
FIG. 4 is a top view of a cup having four radially placed end pipes belonging to a device according to the present invention.
Figure 5:
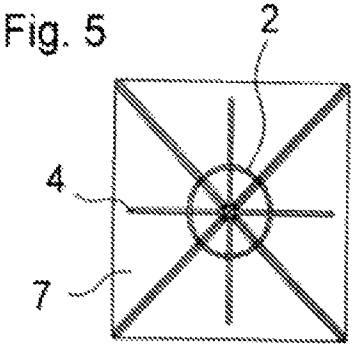
FIG. 5 is a top view of a structure supporting a funnel-shaped container of a device according to the present invention.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

Volatile sulfur compounds are one of the main causes of olfactory defects and poor aroma expression, especially in wines subjected to aging in bottle. The perception thresholds of these aromas are very low (below one microgram per liter) and therefore, even the presence of small amounts of these molecules is able to modify negatively the sensory profile of the wine. These sensory deviations take place when, due to the low redox potential that occurs in a bottle of wine during storage, such molecules are present in their thiol form.

Before bottling, wine redox potential is relatively high and therefore the sulfur compounds are mainly present as disulfide instead of thiol. In such form, they have a lower volatility, and poorly affect the organoleptic expression of the wine, which may be more or less evident, independently from their concentration.

Disulfides are unstable molecules and in presence of a reducing environment, as in a bottle, they may be reduced or hydrolyzed to mercaptans, which are more perceivable and may mask the other volatile compounds.

| Low Redox | | High Redox |
|---|---|---|
| Solfides | | Disulfides |
| R—SH | | R—S |
| $+O_2$ | → | $\mid +H_2O$ |
| R—SH | | R—S |
| Negative Molecules | | Positive Molecules |
| Smelly | | No Smell |
| They cover the wine | | They uncover the wine |

When the bottle is uncorked, and the atmospheric oxygen dissolves into the wine, the redox potential increases again and sulfur compounds tend to turn back into their disulfide forms. The disulfides have a much higher perception threshold and a neutral organoleptic expressions. This allows the taster to clearly perceive the aromatic and distinctive characteristics of the wine. The oxygenation with conventional systems: decanters or glasses with large exposed surface may not be enough to activate this type of reaction quickly.

Accordingly, the invention relates to a more complex system providing, inside of a suitable funnel-like container, a multitude of spherical or nearly-spherical elements whose diameter is significantly smaller than the diameter of the outlet pipe of the container, allowing a significant, exponential increase of the contact surface between oxygen and wine.

The presence of the spherical or nearly-spherical elements inside the funnel-like container also allows the wine to drop with a very slow infiltration motion comparable to a laminar motion. Only in the area directly in contact with the spherical or nearly-spherical elements, within a very thin boundary layer, it creates a turbulent motion that allows a sort of micro-oxygenation of the wine present in this layer.

According to an advantageous form of an embodiment of the invention, said spherical or nearly-spherical elements are made of glass. Moreover, according to another advantageous form of embodiment of the invention, said funnel-like container is also made of glass. According to other forms of embodiment of the invention, either the funnel-like container or the spherical or nearly-spherical elements or both are either made of a plastic material such as, for instance, a polymeric resin, or of a stone material such as marble, granite, quartz, or of wood, or of metal.

According to another important feature of the invention, a non-spherical element with a size significantly greater than the spherical or nearly-spherical elements, and also greater than the diameter of the container's outlet aperture, is positioned at the base of the funnel-like container, thereby performing a containment function of the said spherical or nearly-spherical elements, in particular preventing them to exit the container through the outlet aperture or pipe. Moreover, said non-spherical element represents a friction element on the liquid which, due to its roughness, increases the turbulent motion, and therefore also the oxygenation, before the wine comes out from the funnel-like container. The result is that wine undergoes a much greater micro-oxygenation effect, with respect to the direct pouring from the bottle to common conventional systems currently marketed. Therefore, the transformation of the odorous mercaptans into olfactively neutral disulfides occurs, and this emphasized the perception of the positive aroma molecules present in the wine, also increasing the aromatic intensity of wine itself.

According to an advantageous form of embodiment of the invention, said non-spherical element has a faceted outer surface. According to another form of embodiment of the invention, said non-spherical element has a flat shape provided with a plurality of through holes allowing the passage of wine. According to another advantageous form of embodiment of the invention, said non-spherical element is either made of glass or of a plastic material such as, for instance, a polymeric resin, or of a stone material such as marble, granite, quartz, or of wood or of metal. Moreover, according to another form of embodiment of the invention, more than a single non-spherical element of a size larger than the outlet aperture can be provided at the bottom of the funnel-like container. In this case differently colored non-spherical elements can be used, thereby providing different chromatic effects when the container, the microspheres and the non spherical elements are made of glass and an impinging light is directed towards the container.

Briefly, the present invention involves the use, inside of a funnel-like container, of a multitude of spherical or nearly-spherical elements which can defined as "microspheres" and of an element of a larger, non-spherical size, thereby allowing the positive aromatic component of the wine to be released more quickly, more efficiently and significantly.

The invention was developed focusing on wine, but it may also be used for any fluid that presents molecules with similar oxygen reactivity towards the molecules mentioned above. The purpose of the present invention is that to obtain a perfect aeration or oxygenation of the wine in a very short time, practically instantaneously. In particular, the invention aims to provide a device able to considerably increase the exchange surface for aerating or oxygenating wine compared to the one provided by an ordinary decanter.

According to an aspect, the device according to the invention comprises a series of components mounted on top of each other, whereby the wine poured from a bottle flows in sequential order, by force of gravity, through these components until it flows into glasses to be served to consumers. The structure of said components is such that each component enhances exposure to air and maximum oxygenation of the wine flowing through it.

The main component of the device according to an aspect of the invention is constituted by a funnel-shaped container adapted to contain a plurality of small freely-movable spheres, the end of said container being a pipe with vertical axis. When a bottle of wine is poured inside said container, the wine flow is "broken up" by the spheres and is continuously deviated, thereby allowing the wine being poured to be in contact with air. As a consequence, the desired aeration or oxygenation process much more rapidly than in a traditional decanter.

Moreover, according to an aspect of the invention, the end pipe of said funnel-shaped container leads the wine poured inside it into a cup that is placed beneath said container, thereby enhancing a further aeration or oxygenation of the wine poured into said cup owing to the shape of the cup. According to another aspect of the invention, the cup is provided, under its bottom wall, with four radial wine distribution pipes through which the wine flows towards an additional component of the device according to the invention. This additional component practically consists in a pyramid-shaped dispenser having a supporting said cup on its vertex. The four inclined edges of said dispenser are configured as U-shaped conduits or grooves. Moreover, said radial wine distribution pipes of said cup match with said U-shaped conduits of said dispenser, whereby the wine flowing inside the U-shaped conduits is poured inside corresponding glasses placed beneath the terminal end of said conduits. It is important to mention that the wine streaming downwardly within the U-shaped conduits is also exposed to air in a dynamic condition enhancing additional aeration or oxygenation.

Advantageously, the components of the device according to the present invention are supported by a height-adjustable base keeping in a horizontal position all the components of the device, as well as the glasses.

The illustrated example embodiments will be best understood by reference to the figures. The following description is intended only by way of example, and simply illustrates certain example embodiments.

In the drawings, a device (1) is provided with a stabilization base (10) having a substantially square shape, suitable for being placed on a table or any other horizontal surface. Said base (10) is provided with four height-adjustable feet, essentially consisting in four screws with vertical axis (11) engaged into threaded holes crossing the entire thickness of the base (10). By setting said screws (11) a user may place said base (10), and thereby the whole device (1) in a horizontal position. In fact, a perfectly horizontal position of said base (10) is the necessary condition to obtain a uniform filling of glasses (8) positioned at the four corners of the base (10).

Figure 3:
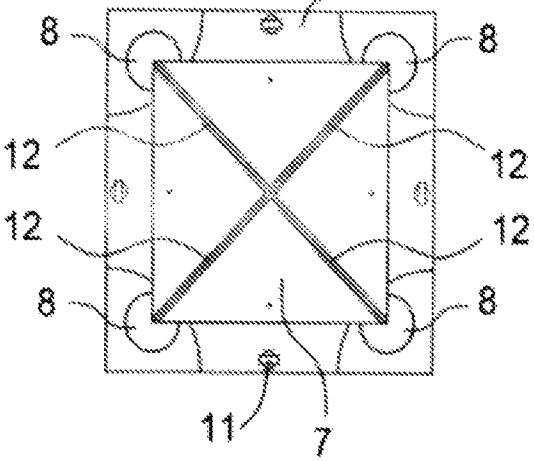
FIG. 3 is a top view of a pyramid-shaped dispenser of device according to the present.
Figure 2:
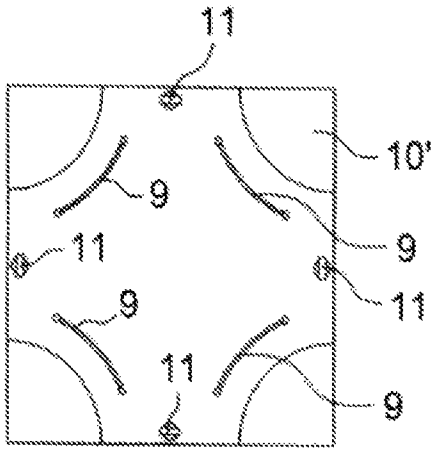
FIG. 2 is a top view of a height-adjustable base of a device according to the present invention.

Referring to FIGS. 1 and 2, four slightly curved vertical supports (9) protrude from the upper surface of the base (10), the edges of which are directed towards the four corners of the base, said supports (9) being suitable for supporting a pyramid-shaped dispenser (7) having a square base. As shown in FIG. 3, said dispenser (7) has a considerably smaller surface than the base (10), and it is placed centrally on said base (10). FIG. 3 also shows four inclined conduits (12), which are respectively placed in correspondence of the four inclined edges of the pyramidal structure. Accordingly, the conduits (12) substantially end at the four corners of the base (10) in correspondence of areas (10') acting as support surface for supporting four respective glasses (8) on the base (10).

As shown in FIG. 1, the height of said vertical supports (9) interposed between base (10) and dispenser (7) is slightly higher than the height of a typical wine goblet. Hence, each glass (8) is placed under the lower end of a corresponding inclined conduit (12) of said dispenser (7). Referring to FIG. 2, said supports (9) are disposed on the base (10) in more internal position with respect to said areas (10') for supporting the glasses (8). Such a position of said supports (9), with their concave profile facing the angular areas (10') of the base (10), guarantees that their presence does not hinder the positioning of glasses (8) in correspondence of the areas (10').

A cup (5) is placed above said pyramidal dispenser (7), said cup being provided, in correspondence of its bottom wall, with four radial wine distribution pipes (6), each of them being spaced from an adjacent one by an angle of 90°. Such cup (5) is mounted on the vertex of the pyramidal dispenser (7), in such manner that said pipes (6) are exactly aligned with said inclined conduits (12) provided in said dispenser (7).

FIG. 1 clearly shows the position and configuration of said cup (5), as well as the special tapered downward profile given to the free end of each of said pipes (6). Because of this special configuration, the free ends of the four pipes (6) act as supporting points for the cup (5), as they are inserted in the corresponding inclined conduits (12) of the dispenser (7). A vertical, frustoconical-shaped, cage structure (4), preferably made of metal sections, is fixed above said dispenser (7). This structure (4) comprises four upward-converging rods (4*a*) connected by two metal rings (4', 4") placed on respective horizontal planes, the first one (4') having a larger diameter being positioned approximately at a half of the height of the rods (4*a*) and the second one (4") having a considerably smaller diameter being positioned in correspondence of the top of said vertical structure (4), thereby forming an upper opening. More precisely, the lower end of each rod (4*a*) is fixed centrally at the lower side of one of the triangular sloping walls of said pyramidal dispenser (7). This frusto-conical vertical structure (4) supports a funnel-shaped container (2) in correspondence of said upper opening.

Moreover, considering that the vertical structure (4) is centered with respect to the pyramidal dispenser (7), it may easily be understood that the funnel-shaped container (2) supported by said structure (4) is vertically aligned to the vertex of said dispenser (7) and is also vertically aligned to said cup (5). In particular, the funnel-shaped container (2) is inserted downwards inside the upper opening of the frusto-conical vertical structure (4), in such manner to rest on said second ring (4"), whose diameter is smaller than the container's upper diameter. As shown in FIG. 1, the funnel-shaped container (2) comprises a vertical pipe (2') connected to the tapered bottom wall of said container, the lower end of said pipe (2') being placed inside said cup (5). Said funnel-shaped container (2) contains a plurality of small glass spheres (3).

The device according to the invention is operated in the following way. The contents of a wine bottle are poured inside said funnel-shaped container (2). Owing to the force of gravity, the wine naturally flows downward to the bottom of the container (2). On the downward path, the wine flow is continuously deviated by the surface of said spheres (3). In other words, the presence of the spheres (3) creates a considerable turbulence in said vertical wine flow, thereby suddenly increasing the oxygen exchange surface. Once the wine reaches the bottom of the funnel-shaped container (2), it flows into said vertical pipe (2'). In this way, the wine is poured inside said cup (5) whose relatively large surface additionally enhances oxygenation of the wine that remains therein for a short time, said cup practically acting as a traditional decanter.

After reaching the bottom of the cup (5), the wine is directed outwards, by force of gravity, through said radial pipes (6). Said radial pipes (6) generate four thin wine flows streaming inside the inclined conduits (12) of the pyramidal dispenser (7). Since the inclined conduits (12) are open on the top, the wine flowing inside them undergoes an additional "dynamic" air exposure, which enhances a further oxygenation. Finally, the wine flowing in the inclined conduits (12 is poured inside the four glasses (8) placed on the base (10) just beneath the lower ends of said conduits (12). The wine, which has sufficiently been oxygenated on its vertical turbulent path, is then ready for being consumed.

It is clear that should a user not intend to fill all the four glasses (8), but only a lower number of them, the user will simply close one of the pipes (6) of the cup (5), thus preventing wine from flowing towards said inclined conduits (12) of the dispenser (7).

According to another form of embodiment of the invention, the device (1) can also be adapted to simultaneously fill a number of glasses (8) higher than four. In this case, said cup (5) is provided with a number of radial distribution pipes (6) higher than four. Consequently, said pyramid-shaped dispenser (7) has a different polygonal base (instead of a square one) so as to be provided with a number of inclined conduits (12) equal to the number of pipes (6) of the cup (5). Finally, the base (10) is in this case provided with a number of glass supporting areas (10') equal to the number of inclined conduits (12) provided in the dispenser (7).

Figure 6:
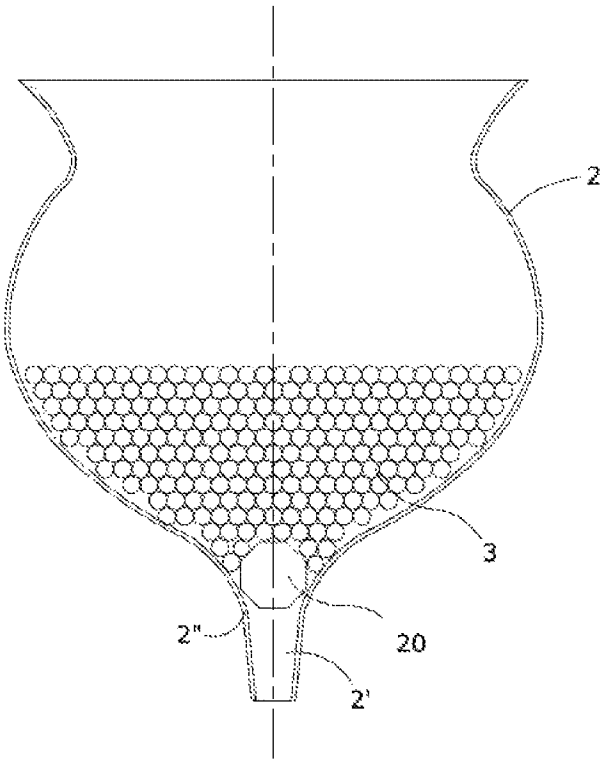
FIG. 6 is a side view of a device according to the invention.
Figure 7:
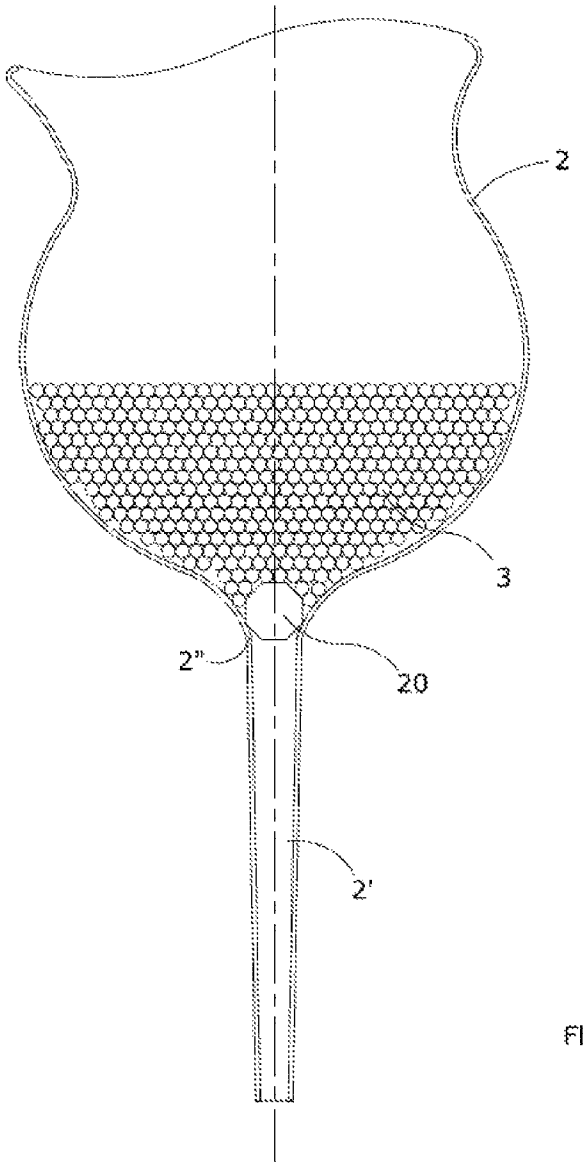
FIG. 7 is a side view of a device according to another form of embodiment of the invention.

In the form of embodiment of the invention illustrated in FIGS. 6 and 7, a funnel-like container (2) that is preferably made of glass has a main body or vessel and an outlet aperture (2") placed at the bottom of said main body or vessel. FIG. 6 shows a relatively short pipe (2') joined to said outlet aperture (2"), while FIG. 7 shows a relatively long pipe (2') joined to said outlet aperture (2"). According to another form of embodiment of the invention, the outlet aperture is not provided with any further pipe and the container is intended to be placed on the top of a wine glass whereby the wine poured into the container (2) flows directly inside of said wine glass.

As illustrated in FIGS. 6 and 7, container (2) is partially filled with a multitude of spherical or nearly-spherical elements (3)—briefly defined as "microspheres"—whose diameter is significantly smaller than the size of the container's outlet aperture (2"). Said microsphere, according to different forms of embodiment, may either be made of glass, or of a plastic material such as, for instance, a polymeric resin, or of a stone material such as marble, granite, quartz, or of wood or of metal. As previously explained, these microspheres (3) allow a significant, exponential increase of the contact surface between oxygen and wine. In fact, the presence of the spherical or nearly-spherical elements (3) inside the funnel-like container (2) also allows the wine to drop with a very slow infiltration motion comparable to a laminar motion. Only in the area directly in contact with the spherical or nearly-spherical elements (3), within a very thin boundary layer, it creates a turbulent motion that allows a sort of micro-oxygenation of the wine present in this layer.

Moreover, FIGS. 6 and 7 show a further non-spherical element (20) with a size significantly greater than the spherical or nearly-spherical elements (3), and also greater than the diameter of the container's outlet aperture (2"), is positioned at the base of the funnel-like container, thereby performing a containment function of the said spherical or nearly-spherical elements, in particular preventing them to exit the container through the outlet aperture or pipe. Moreover, said non-spherical element (20) represents a friction element on the liquid which, due to its roughness, increases the turbulent motion, and therefore also the oxygenation, before the wine comes out from the funnel-like container. The result is that wine undergoes a much greater micro-oxygenation effect, with respect to the direct pouring from the bottle to common conventional systems currently marketed. Therefore, the transformation of the odorous mercaptans into olfactively neutral disulfides occur, and this emphasized the perception of the positive aroma molecules present in the wine, also increasing the aromatic intensity of wine itself According to an advantageous form of embodiment of the invention (as shown in FIGS. 6 and 7) said non-spherical element (20) has a faceted outer surface. According to another form of embodiment of the invention, said non-spherical element (20) has a flat shape provided with a plurality of through holes allowing the passage of wine. According to another advantageous form of embodiment of the invention, said non-spherical element (20) is either made of glass or of a plastic material such as, for instance, a polymeric resin, or of a stone material such as marble, granite, quartz, or of wood or of metal.

Moreover, according to another form of embodiment of the invention, more than a single non-spherical element (20) of a size larger than the outlet aperture can be provided at the bottom of the funnel-like container (2). In this case differently colored non-spherical elements can be used, thereby providing different chromatic effects when the container, the microspheres (3) and the non-spherical elements (20) are made of glass and a light ray is directed towards the container.

Briefly, the present invention involves the use, inside of a funnel-like container (2), of a multitude of spherical or nearly-spherical elements (3) which can defined as "microspheres" and of an element (20) of a larger, non-spherical size, thereby allowing the positive aromatic component of the wine to be released more quickly, more efficiently and significantly. The invention was developed focusing on wine, but it may also be used for any fluid that presents molecules with similar oxygen reactivity towards the molecules mentioned above.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A wine aerating device, comprising:

a funnel-shaped container comprising a bottom that is provided with an outlet aperture having a predetermined size, wherein said funnel-shaped container is at least partially filled with a multitude of substantially spherical elements for breaking up and diverting a flow of wine streaming from the top to the bottom of said funnel-shaped container, each of said substantially spherical elements having a size significantly smaller than the size of said outlet aperture, and wherein a non-spherical element having a size greater than the size of said outlet aperture is placed upon said outlet aperture in order to partially block it, thereby preventing said spherical or nearly-spherical elements to pass through said outlet aperture while allowing the passage of wine through said outlet aperture and increasing the wine's turbulent motion and oxigenation while coming out of said funnel-shaped container.

2. The device of claim 1, wherein a pipe of a predetermined length is joined to said outlet aperture.

3. The device of claim 1, wherein said funnel-shaped container is made of glass.

4. The device of claim 1, wherein said funnel-shaped container is made of a synthetic resin.

5. The device of claim 1, wherein said funnel-shaped container is made of a stone material selected from the group consisting of marble, granite, and quartz.

6. The device of claim 1, wherein said funnel-shaped container is made of wood.

7. The device of claim 1, wherein said funnel-shaped container is made of metal.

8. The device of claim 1, wherein said substantially spherical elements are made of glass.

9. The device of claim 1, wherein said substantially spherical elements are made of a synthetic resin.

10. The device of claim 1, wherein said substantially spherical elements are made of a stone material selected from the group consisting of marble, granite and quartz.

11. The device of claim 1, wherein said substantially spherical elements are made of wood.

12. The device of claim 1, wherein said substantially spherical elements are made of metal.

13. The device of claim 1, wherein said non-spherical element is made of glass.

14. The device of claim 1, wherein said non-spherical element is made of a synthetic resin.

15. The device of claim 1, wherein said non-spherical element is made of a stone material selected from the group consisting of marble, granite and quartz.

16. The device of claim 1, wherein said non-spherical element is made of wood.

17. The device of claim 1, wherein said non-spherical element is made of metal.

18. The device of claim 1, wherein said non-spherical element has a flat shape and is provided with a plurality of apertures having a predetermined size allowing the passage of wine and preventing the passage of the substantially spherical elements.

19. The device of claim 1, wherein more than one substantially spherical element is placed on the bottom of said funnel-like container.

* * * * *